US012084256B1

(12) United States Patent
Xu

(10) Patent No.: US 12,084,256 B1
(45) Date of Patent: Sep. 10, 2024

(54) SEALING DEVICE

(71) Applicant: Shen Zhen Yousheng Electrical Appliance Co., Ltd., Shenzhen (CN)

(72) Inventor: Jingjie Xu, Shenzhen (CN)

(73) Assignee: SHEN ZHEN YOUSHENG ELECTRICAL APPLIANCE CO., LTD., Shenzhen (CN)

( * ) Notice: Subject to any disclaimer, the term of this patent is extended or adjusted under 35 U.S.C. 154(b) by 0 days.

(21) Appl. No.: 18/590,984

(22) Filed: Feb. 29, 2024

(30) Foreign Application Priority Data

Dec. 29, 2023 (CN) ..... 202323659451.X

(51) Int. Cl.
*B65D 81/20* (2006.01)

(52) U.S. Cl.
CPC ..... *B65D 81/2038* (2013.01)

(58) Field of Classification Search
CPC .. B67B 3/24; B65D 81/2007; B65D 43/0202; B65D 53/02; B65D 81/2038; B65D 43/02; B65D 2543/00972; B65D 2543/00564; B65D 2543/00546; B65D 2543/00527; B65D 2543/00296; B65D 2543/00092
USPC ..... 99/472, 483; 141/70; 53/109, 268, 407
See application file for complete search history.

(56) References Cited

U.S. PATENT DOCUMENTS 2,017,766 A * 10/1935 Mullen ..... B67B 3/24 141/70
3,939,287 A * 2/1976 Orwig ..... B65B 55/18 426/316
4,218,967 A * 8/1980 Batchelor ..... B65D 81/2038 206/524.8
6,148,875 A * 11/2000 Breen ..... F25D 17/042 141/192
7,571,748 B2 * 8/2009 Shao ..... B65B 31/00 206/524.8
9,359,121 B1 * 6/2016 Hsieh ..... B65D 81/2038
9,376,223 B2 * 6/2016 Im ..... B65B 3/12
2003/0070563 A1 * 4/2003 Wang ..... B65D 81/2015 99/472
2005/0061812 A1 * 3/2005 Vilalta ..... B65D 79/0087 220/212
2005/0074342 A1 * 4/2005 Lemme ..... F04B 33/00 417/415
2005/0172834 A1 * 8/2005 Lee ..... B65B 31/046 99/472

(Continued)

*Primary Examiner* — Eric S Stapleton
(74) *Attorney, Agent, or Firm* — Andrew C. Cheng

(57) ABSTRACT

A sealing device for sealing a cover on a mouth of a container, includes a main machine including a housing, a vacuum pump, an air extraction channel, an air inlet channel and a control valve for controlling open and close of the air inlet channel. The housing includes a sleeve joint part defining a first accommodating space adapted to the mouth. The vacuum pump is arranged in the housing and includes an air extraction port. The air extraction channel communicates the air extraction port with the first accommodating space and the air inlet channel communicates the first accommodating space with ambient air. The sealing device further includes an air duct which may be selectively connected to the housing and is respectively communicated with the air inlet channel and the air extraction channel. The sealing device can not only vacuum and seal jars, but also creates a vacuum in compression bags.

18 Claims, 5 Drawing Sheets

(56) References Cited

U.S. PATENT DOCUMENTS

| | | | | |
|---|---|---|---|---|
| 2006/0032852 | A1* | 2/2006 | Cai | B65D 51/1683 220/804 |
| 2006/0150829 | A1* | 7/2006 | Cheung | B65D 81/2084 99/472 |
| 2007/0193915 | A1* | 8/2007 | Shao | B65D 85/50 206/524.8 |
| 2007/0199283 | A1* | 8/2007 | Sung | B65B 31/046 53/512 |
| 2008/0131567 | A1* | 6/2008 | Lemme | F04B 35/04 426/418 |
| 2009/0130271 | A1* | 5/2009 | Burke | A23B 4/16 99/474 |
| 2011/0115243 | A1* | 5/2011 | Desai | B66C 1/0212 294/65 |
| 2012/0207898 | A1* | 8/2012 | Olejar | A23B 4/0526 426/474 |
| 2013/0255830 | A1* | 10/2013 | Im | B65D 81/2015 141/26 |
| 2014/0141139 | A1* | 5/2014 | Gottschlich | A23B 7/148 99/473 |
| 2015/0037483 | A1* | 2/2015 | Giger | A23L 3/364 426/524 |
| 2018/0093814 | A1* | 4/2018 | Espinosa | A23L 3/28 |
| 2018/0282006 | A1* | 10/2018 | Grip | B61B 13/10 |

* cited by examiner

SEALING DEVICE

TECHNICAL FIELD

The present disclosure relates to a sealing device, and in particular, to a sealing device.

BACKGROUND

Raw or cooked food is generally vacuum-sealed within jars or compression bags. Clothes, documents, electronic products and other items are sometimes sealed within compression bags to prevent moisture.

When vacuumizing the jars and compression bags, corresponding vacuumizing equipment is needed. The existing sealing device is generally only used to vacuum the jar or only used to vacuum the compression bag. If there is a need to vacuum a jar and vacuum a compression bag, different sealing devices are needed.

SUMMARY

The technical problem to be solved by the present disclosure is to provide a sealing device.

The technical solution adopted by the present disclosure to solve the technical problems is as follows:

The present disclosure provides a sealing device configured for sealing a first sealing cover on a first mouth of a first container. The sealing device comprises a main machine which comprises:

A housing comprising a first sleeve joint part, wherein the first sleeve joint part defines a first accommodating space adapted to the first mouth.

A vacuum pump mounted to the housing and comprising an air extraction port.

An air extraction channel defined in the housing and communicating the air extraction port with the first accommodating space.

An air inlet channel defined in the housing and communicating the first accommodating space with ambient air. And A control valve mounted to the housing and used for controlling open and close of the air inlet channel.

The sealing device further comprises an air duct, and one end of the air duct is selectively connected to the housing and is respectively communicated with the air inlet channel and the air extraction channel.

In some embodiments, the first sleeve joint part comprises a top wall and a tubular side wall extending from a periphery of the top wall, and at least one air extraction hole and at least one air inlet hole are formed on the top wall; and the air extraction hole communicates the air extraction channel with the first accommodating space, and the air inlet hole communicates the air inlet channel with the first accommodating space.

In some embodiments, an annular first sealing groove is defined in an inner surface of the side wall, the main machine further comprises an annular first sealing gasket, and the first sealing gasket is arranged in the first sealing groove.

In some embodiments, an air inlet recess is formed on a lower end surface of the top wall, and both the air extraction hole and the air inlet hole are formed in a wall of the air inlet recess.

In some embodiments, a lower end surface of the top wall is provided with at least one first cushion block.

In some embodiments, the sealing device further comprises a conversion structure for sealing a second sealing cover on a second mouth of a second container, and an outer diameter of the second mouth is not equal to that of the first mouth; the conversion structure is selectively connected to the housing; the air duct is selectively connected to the housing through the conversion structure.

In some embodiments, the conversion structure comprises a second sleeve joint part, the second sleeve joint part defines a second accommodating space adapted to the second mouth; and a vent hole communicating the second accommodating space with the first accommodating space is formed in the second sleeve joint part.

In some embodiments, the second sleeve joint part comprises a second portion and an annular first portion, wherein the second portion comprises a top wall and a tubular side wall, the top wall is arranged at an upper end of the side wall, and the first portion is arranged at a lower end of the side wall; an outer diameter of the side wall is matched with a diameter of the first accommodating space, and an inner diameter of the side wall is matched with an inner diameter of the first portion, and the first portion is selectively connected with the housing.

In some embodiments, at least part of an inner surface of the first portion or at least part of the inner surfaces of the first portion and the side wall of the second portion are formed with an annular second sealing groove, and the conversion structure further comprises an annular second sealing gasket which is arranged in the second sealing groove; inner diameters of the first portion and the side wall are adapted to an outer diameter of the second mouth and larger than a diameter of the second sealing cover, and inner diameters of the second sealing gasket are smaller than those of the first portion and the third side wall.

In some embodiments, the air duct comprises a first end and a second end opposite to the first end, the first end is selectively connected to the housing, and the second end is provided with a third sealing gasket.

In some embodiments, the second sleeve joint part further comprises a third portion, and the third portion comprises a top wall and a tubular side wall; the top wall of the second portion is set in an annular manner; the top wall of the third portion is arranged at an upper end of the side wall of the third portion, a lower end of the side wall of the third portion is connected with an inner side of the top wall of the second portion, and the at least one vent hole is formed on the top wall of the third portion.

In some embodiments, at least one second cushion block is arranged on a lower end surface of the top wall of the second portion.

In some embodiments, one end of the air duct is selectively connected to the second sleeve joint part and is communicated with the first accommodating space through the vent hole.

In some embodiments, the second sleeve joint part comprises a third portion, and the third portion comprises a top wall and a tubular side wall, and the top wall of the third portion is arranged at an upper end of the side wall of the third portion, and the at least one vent hole is formed in the top wall of the third portion.

The air duct comprises a fourth body and a fourth sealing gasket, wherein the fourth body is selectively connected with the third portion, and comprises a fourth portion and a fifth portion which are connected along an axial direction; an outer diameter of the fourth portion is matched with an inner diameter of the fourth side wall, an annular fourth sealing groove is formed in an outer wall surface of the fourth portion, and the fourth sealing gasket is arranged in the fourth sealing groove; and an outer diameter of the fourth sealing gasket is larger than that of the fourth portion.

In some embodiments, the sealing device further comprises a main control board which is arranged in the housing, the vacuum pump and the control valve are electrically connected to the main control board respectively.

The present disclosure also provides a sealing device configured for sealing a first sealing cover on a first mouth of a first container. The sealing device comprises a main machine which comprises:

A housing comprising a first sleeve joint part, wherein the first sleeve joint part defines a first accommodating space adapted to the first mouth.

A vacuum pump mounted to the housing and comprising an air extraction port.

An air extraction channel defined in the housing and communicating the air extraction port with the first accommodating space.

An air inlet channel defined in the housing and communicating the first accommodating space with ambient air. And A control valve mounted to the housing and used for controlling open and close of the air inlet channel.

Wherein the sealing device further comprises an air duct, and one end of the air duct is detachably connected to the housing and is respectively communicated with the air inlet channel and the air extraction channel.

In some embodiments, the first sleeve joint part comprises a top wall and a tubular side wall extending from a periphery of the top wall, and at least one air extraction hole and at least one air inlet hole are formed on the top wall; and the air extraction hole communicates the air extraction channel with the first accommodating space, and the air inlet hole communicates the air inlet channel with the first accommodating space.

In some embodiments, the sealing device further comprises a conversion structure for sealing a second sealing cover on a second mouth of a second container, and an outer diameter of the second mouth is not equal to that of the first mouth; the conversion structure is detachably connected to the housing; the air duct is detachably connected to the housing through the conversion structure.

In some embodiments, wherein the conversion structure comprises a second sleeve joint part, the second sleeve joint part defines a second accommodating space adapted to the second mouth; and a vent hole communicating the second accommodating space with the first accommodating space is formed in the second sleeve joint part.

Wherein one end of the air duct is detachably connected to the second sleeve joint part and is communicated with the first accommodating space through the vent hole.

In some embodiments, the sealing device further comprises a main control board which is arranged in the housing, the vacuum pump and the control valve are electrically connected to the main control board respectively.

The present disclosure has at least the following advantages:

by providing an air duct selectively/detachably connected with the main machine, both the jars and the compression bags are able to be vacuum-sealed by the the sealing device, so that one sealing device has various vacuum pumping functions.

DESCRIPTION OF DRAWINGS

The present disclosure will be further explained with the attached drawings and examples. In the drawings.

DETAILED DESCRIPTION

In order to have a clearer understanding of the technical features, purposes and effects of this present disclosure, the specific implementation mode of this present disclosure will be described in detail with reference to the attached drawings.

The terms "connection" and "linking" used here may refer to direct connection, indirect connection, direct linking and indirect linking. "Multiple" means two or more. "First" and "second" are only for the convenience of distinguishing different parts, and cannot be understood as implying relative importance or the number of parts.

Figure 1:
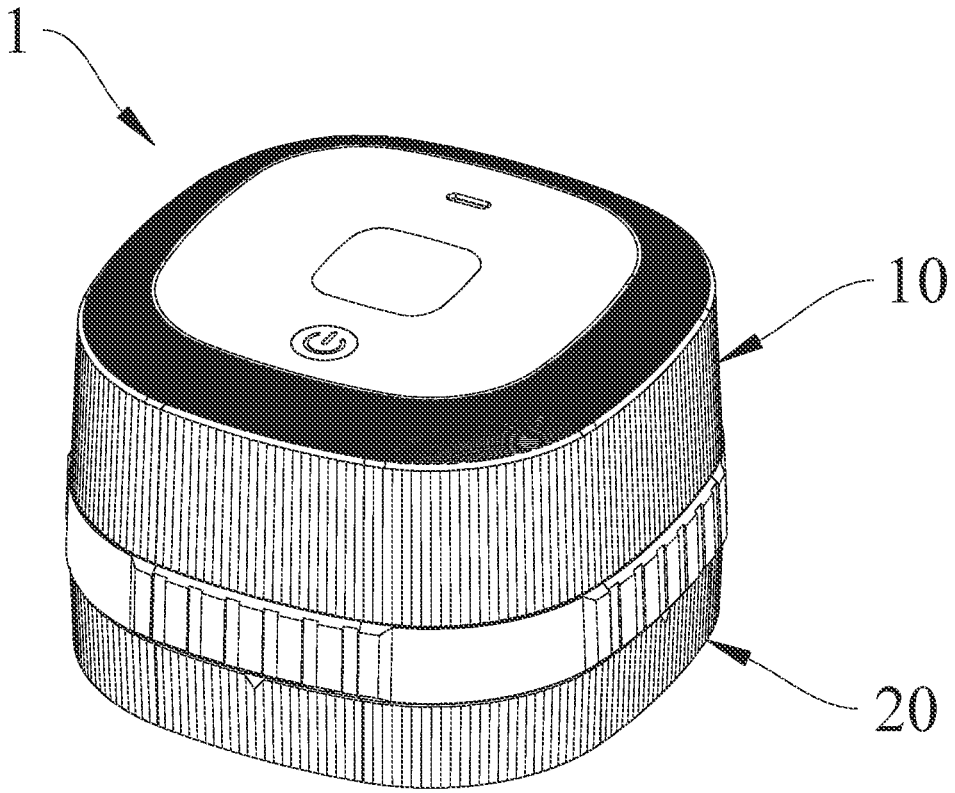
FIG. 1 is a perspective view of a sealing device according to an embodiment of the present disclosure.
Figure 2:
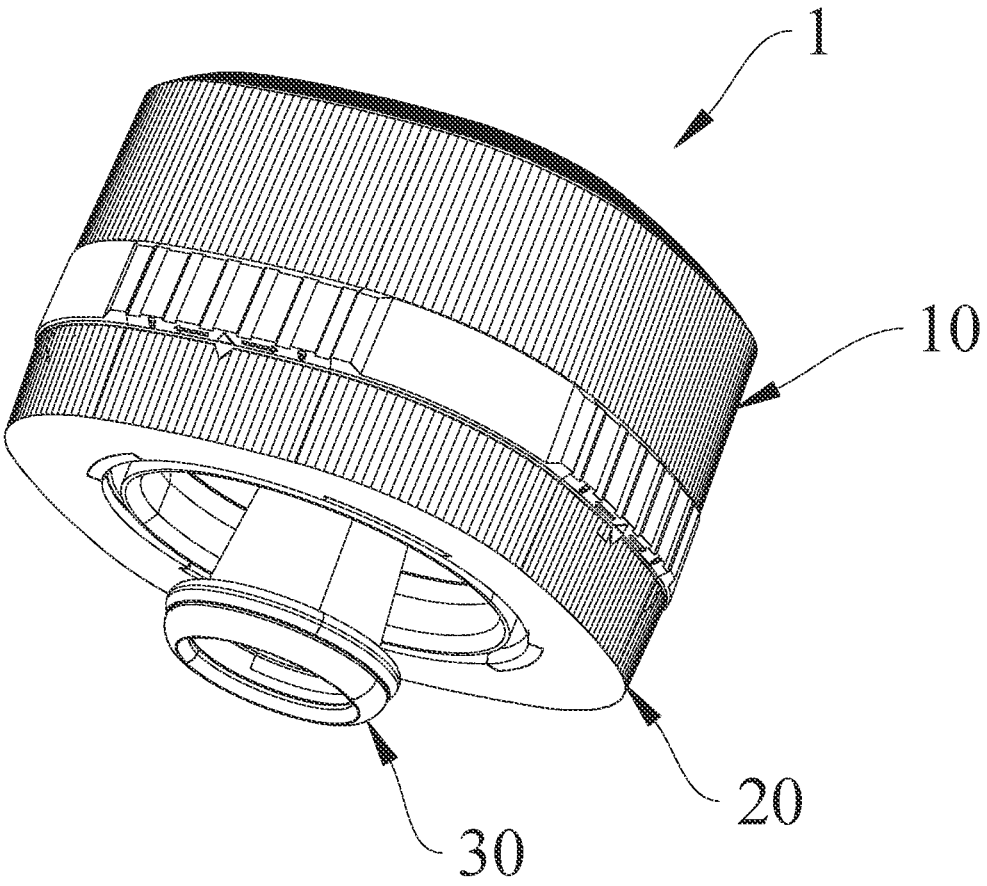
FIG. 2 is a perspective view of the sealing device shown in FIG. 1, viewed from another aspect.

FIGS. 1 and 2 show a sealing device 1 in accordance with an embodiment of the present disclosure. The sealing device 1 can vacuum-seal both jars and compression bags. In some embodiments, the jars may be Mason jars. The sealing device 1 may include a main machine 10 and an air duct 30 selectively connected to the main machine 10, wherein the main machine 10 defines a first accommodating space 18 configured for accommodating a jar mouth of a first jar and a first sealing cover. When the jar mouth of the first jar and the first sealing cover are received within the first accommodating space 18, the main machine 10 is able to vacuum the first jar via the jar mouth, and then enable the first sealing cover to seal the jar mouth. One end of the air duct 30 may be selectively arranged on the main machine 10 for communicating with the interior of the compression bag and vacuumizing the compression bag.

Figure 3:
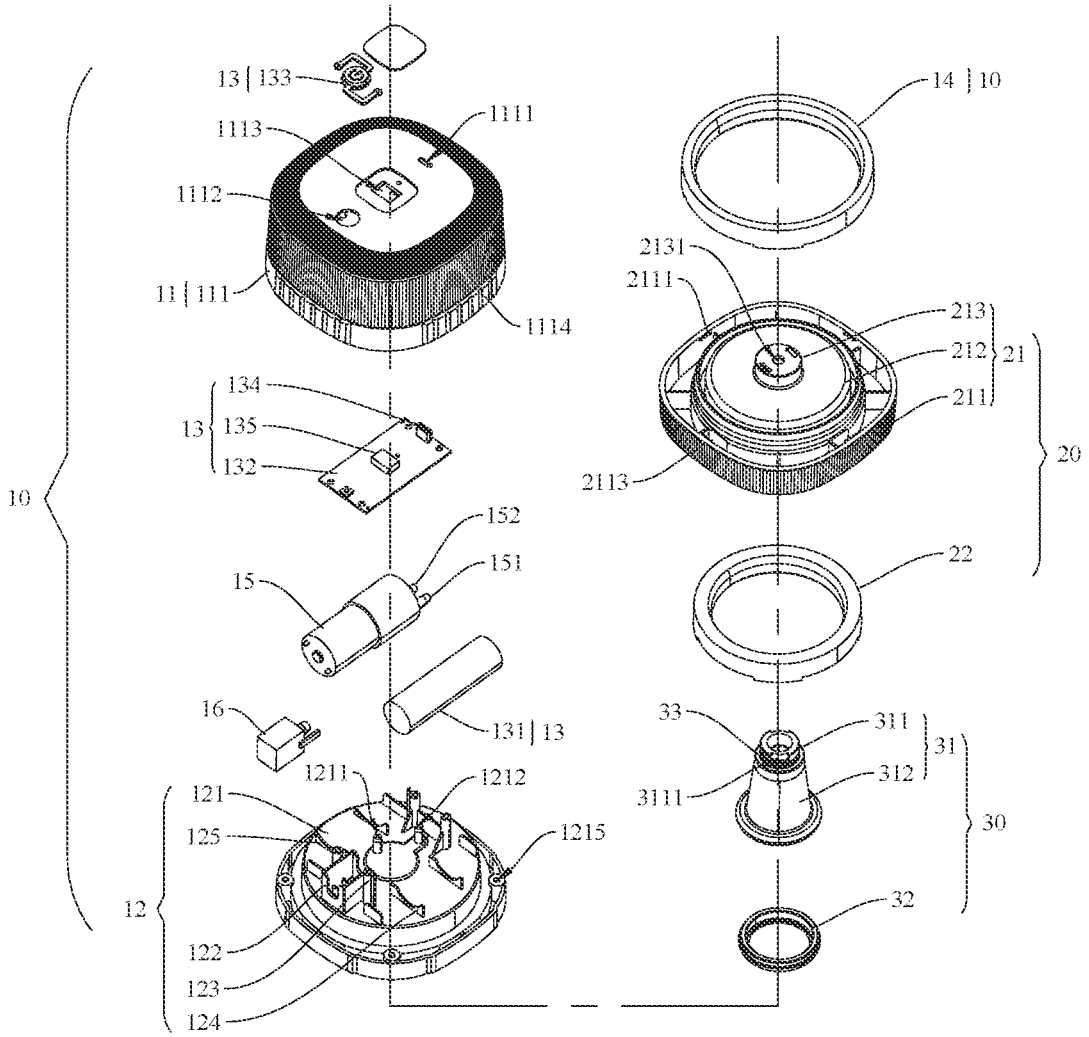
FIG. 3 is an exploded view of the sealing device shown in FIG. 1.
Figure 4:
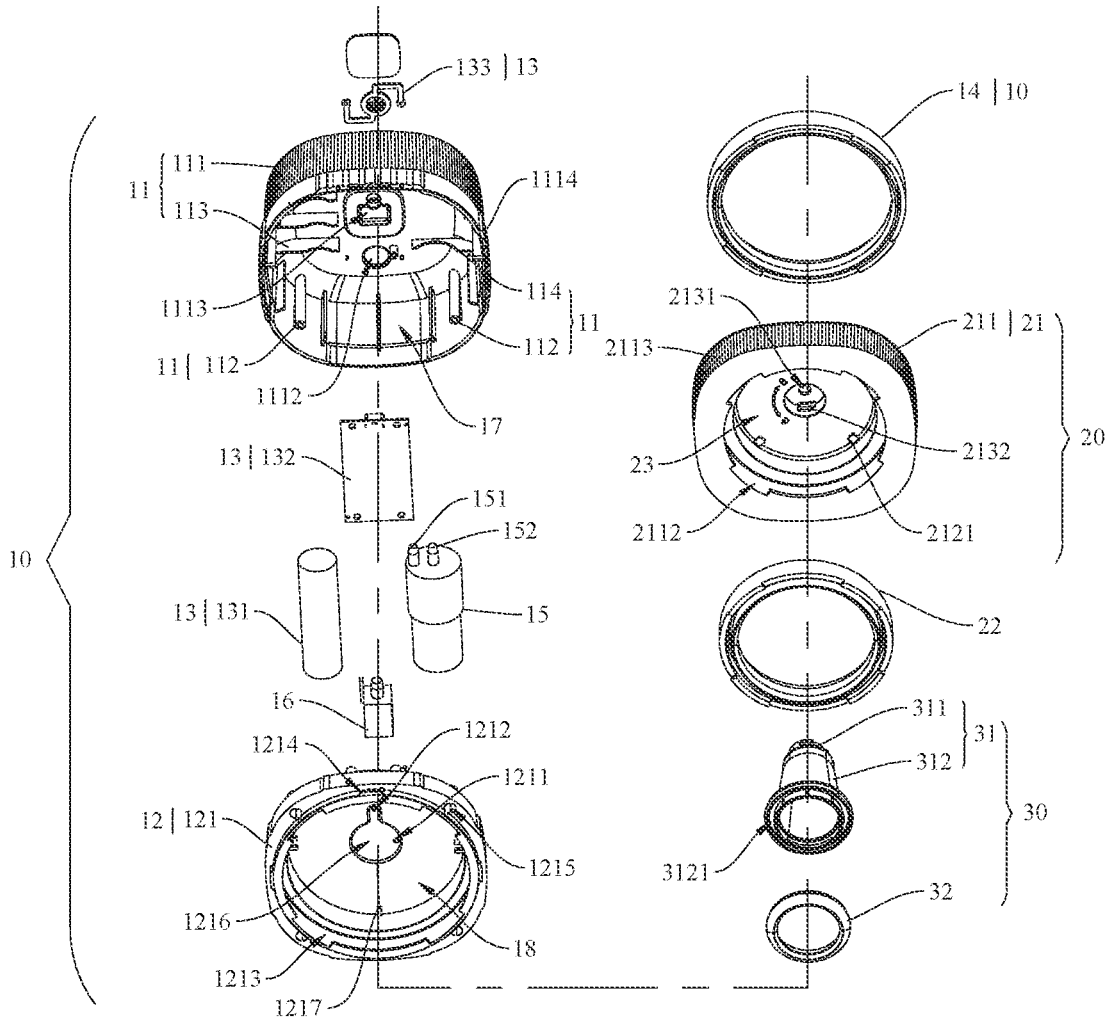
FIG. 4 is an exploded view of the sealing device shown in FIG. 1, viewed from another aspect.

Referring to FIG. 3 and FIG. 4, the main machine 10 may include a housing, a vacuum pump 15, an air extraction channel, an air inlet channel and a control valve 16. The housing includes an upper cover 11 and a bottom cover 12. The bottom cover 12 includes a first sleeve joint part 121 which defines the first accommodating space 18, and the first accommodating space 18 is matched with the first jar mouth.

The vacuum pump 15 mounted to the housing and includes an air extraction port 151, the air extraction channel defined in the housing is used to communicate the air extraction port 151 with the first accommodating space 18, and the air inlet channel defined in the housing is used to communicate the first accommodating space 18 with the ambient air. The control valve 16 mounted to the housing and is used to control open and close of the air inlet channel. One end of the air duct 30 connected to the main machine 10 is also respectively communicated with the air inlet channel and the air extraction channel, so that the vacuum pump 15 can vacuum the compression bag through the air duct 30.

In this embodiment, the upper cover 11 and bottom cover 12 detachably connected together and defined an accommodating chamber 17. Both the vacuum pump 15 and the control valve 16 are received in the accommodating chamber 17.

It should be understood that the shape of the first accommodating space 18 needs to match the shape of the mouth of the first jar, which is cylindrical in this embodiment. In other alternative embodiments, the mouth of the first jar can also be other shapes such as rectangular columns.

The upper cover 11 includes a first body 111, and the first body 111 is detachably connected with a first sleeve joint part 121 of the bottom cover 12. The first body 111 and the first sleeve joint part 121 cooperatively define the accommodating chamber 17. In some embodiments, the first body 111 has a tubular structure with one end open and the other end closed, and includes a first top wall and a first side wall. The first side wall is arranged in a tubular shape, and the first top wall is arranged at the upper end of the first side wall.

In this embodiment, the first side wall is a rectangular tubular structure with rounded corners at four corners. The first top wall is correspondingly arranged in a rectangular shape with rounded corners, and the first top wall and the first side wall are integrally formed. In other embodiments, the cross section of the first side wall can also take other shapes, such as circle, triangle, polygon, irregularity, etc., and the shape of the first top wall corresponds to the shape of the cross section of the first side wall. The first top wall and the first side wall can also be fixed together by welding, gluing, screwing and the like.

In some embodiments, the main machine 10 further includes an electric control module 13, which is arranged in the accommodating chamber 17 and used for controlling the operation of the sealing device 1. The electronic control module 13 includes a battery 131, a button 133, a charging connector 134 and a display module 135. The first top wall 111 defines a charging hole 1111, a button hole 1112 and a display hole 1113 which pass through the first top wall 111 along the thickness direction thereof, wherein the button 133 can move up and down in the button hole 1112 to control the opening and closing of the sealing device 1. The charging connector 134 is installed in the charging hole 1111 for charging the battery 131. The display module 135 is provided corresponding to the display hole 1113, and is used for displaying the vacuumizing duration.

In some embodiments, the upper end of the display hole 1113 is further provided with a transparent partition for protecting the display module 135.

In some embodiments, the charging hole 1111 and/or the button hole 1112 and/or the display hole 1113 may also be formed in the first side wall or the first sleeve joint part 121.

At least part of the outer circumferential surface of the first side wall is further provided with one or more first ribs 1114, which facilitates disassembly and installation of the main machine 10 and increases the friction force during assembly and use.

In some embodiments, the upper cover 11 further includes a first positioning plate 113 and a second positioning plate 114, which are respectively arranged on the inner surface of the first top wall 111 to define the installation positions of the battery 131 and the vacuum pump 15 in the accommodating chamber 17.

As shown in FIG. 3, the first sleeve joint part 121 includes a second top wall and a second side wall. The second side wall is arranged in a cylindrical shape, and the shape of its outer side surface is matched with that of the inner side surface of the first side wall. When the first body 111 is assembled with the first sleeve joint part 121, the first sleeve joint part 121 is accommodated in the space defined by the first top wall and the first side wall of the first body 111. The first top wall, the first side wall, the second top wall and the second side wall together define the accommodating chamber 17.

Specifically, the second top wall is arranged at the upper end of the second side wall, and the second top wall and the second side wall are integrally formed. The first accommodating space 18 and the accommodating chamber 17 are respectively located at the upper and lower sides of the second top wall. In other alternative embodiments, the second top wall and the second side wall can also be fixed by welding, gluing, screwing and like.

At least one air extraction hole 1211 and at least one air inlet hole 1212 pass through the second top wall along the thickness direction thereof. The air extraction hole 1211 is used to communicate the air extraction channel with the first accommodating space 18. The air inlet hole 1212 is used to communicate the air inlet channel with the first accommodating space 18.

In this embodiment, the main machine 10 further includes a first connecting pipe and a second connecting pipe (not shown), wherein the first connecting pipe defines the air extraction channel and the second connecting pipe defines the air inlet channel. Two ends of the first connecting pipe are respectively communicated with the air extraction port 151 and the air extraction hole 1211, and are used for vacuumizing the first accommodating space 18 and the space communicated with the first accommodating space 18 during vacuumizing. Two ends of the second connecting pipe are respectively communicated with the air inlet hole 1212 and the ambient air, and the control valve 16 is arranged at the second connecting pipe to control open and close of the second connecting pipe, so as to open the air inlet hole 1212 through the control valve 16 after vacuumizing, so as to restore the first accommodating space 18 to a non-vacuum state, thereby facilitating to take the first jar from the main machine 10 after vacuumizing.

In other alternative embodiments, the air extraction hole 1211 and the air inlet hole 1212 can be set as the same hole, and the functions of the air extraction hole 1211 and the air inlet hole 1212 can be realized by the same hole. In this case, the main machine 10 can realize the above-mentioned functions simultaneously by setting a herringbone-like connecting pipe, the first end of which is provided with the control valve 16, the second end of which is communicated with the air extraction port 151 of the vacuum pump 15, and the third end of which is communicated with the hole, thereby simultaneously achieving the above functions.

In some embodiments, the vacuum pump 15 further includes an exhaust port 152. The air extraction port 151 is used for pumping air to form a vacuum, and the exhaust port 152 is used for exhausting the air pumped into the vacuum pump 15.

As shown in FIG. 4, in some embodiments, an annular first sealing groove 1213 is formed on the inner side surface of the second side wall, and the main machine 10 further includes an annular first sealing gasket 14, which is accommodated in the first sealing groove 1213 and is used for sealing with the first jar mouth of the first jar in the process of vacuumizing the jar.

Figure 5:
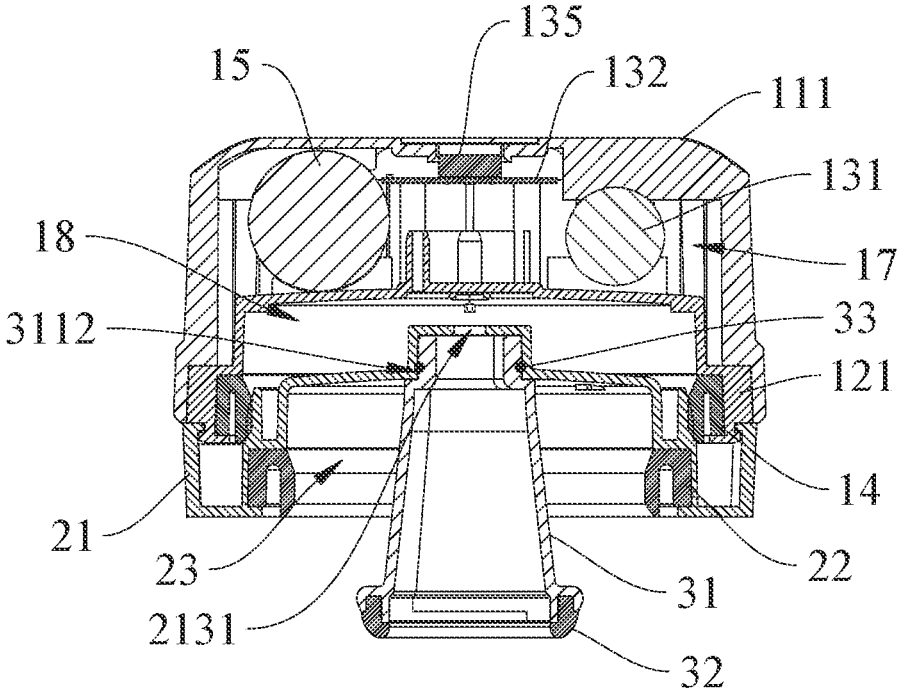
FIG. 5 is a schematic longitudinal sectional view of the sealing device shown in FIG. 1.

Specifically, referring to FIG. 5 together, the inner side surface of the second side wall is round, that is, the first accommodating space 18 is cylindrical, and the inner diameter of the second side wall is adapted to the outer diameter of the first jar mouth, so that the first jar mouth of the first jar can be accommodated in the first accommodating space 18 defined by the second side wall and the second top wall. The inner diameter of the second side wall is larger than the diameter of the first sealing cover, so as to ensure that the first sealing cover is in a moveable state in the first accommodating space 18 during vacuumizing. The inner diameter of the first sealing gasket 14 is slightly smaller than the inner diameter of the second side wall, so that an interference fit is maintained between the mouth of the jar and the first sealing gasket 14, and the sealing effect is achieved, thus ensuring the smooth implementation of vacuumizing.

As shown in FIG. 4, in some embodiments, the lower end surface of the second top wall is formed with an air inlet recess 1216, and both the air extraction hole 1211 and the air inlet hole 1212 are formed on the wall surface of the air inlet recess 1216, so as to ensure that when the first sealing cover is sucked into the first accommodating space 18 to be attached to the lower end surface of the second top wall, the air extraction hole 1211 will not be blocked, so as not to affect the vacuumizing process.

In some embodiments, the lower end surface of the second top wall is further provided with at least one first cushion block 1217, which is used to limit the position of the first sealing cover in the first accommodating space 18 during the vacuumizing process such that the first sealing cover will not be in close contact with the second top wall, so as to ensure the smooth implementation of vacuumizing.

In this embodiment, there are several first cushion blocks 1217, and the first cushion blocks 1217 are arranged at intervals in the circumferential direction of the second top wall.

As shown in FIG. 3, in some embodiments, the bottom cover 12 further includes a third positioning plate 124 and a fourth positioning plate 125, and the third positioning plate 124 cooperates with the first positioning plate 113 to jointly define the position of the battery 131 in the accommodating chamber 17. The fourth locating plate 125 cooperates with the second locating plate 114 to define the position of the vacuum pump 15 in the accommodating chamber 17. In this embodiment, the numbers of the first positioning plate 113, the second positioning plate 114, the third positioning plate 124 and the fourth positioning plate 125 are multiple, so as to improve the positioning stability.

In some embodiments, the bottom cover 12 further includes an accommodating part 122, and an accommodating groove is defined inside the accommodating part 122 for receiving the control valve 16 to define the position of the control valve 16 in the accommodating chamber 17.

In some embodiments, at least one connecting hole 1215 passes through the second side wall in the axial direction, and the upper cover 11 further includes at least one connecting part 112 fixed on the lower end surface of the first top wall or the inner side surface of the first side wall and formed with a connecting groove. The connecting groove is arranged corresponding to the connecting hole 1215. The main machine 10 also includes at least one fitting, which passes through the connecting hole 1215 and the connecting groove at the same time, so that the first body 111 and the first sleeve joint part 121 can be detachably connected.

In this embodiment, the number of the fittings, the connecting parts 112 and the connecting holes 1215 are all four, and the four connecting parts 112 and the connecting holes 1215 are arranged at even intervals along the circumferential direction of the first body 111 and the circumferential direction of the first sleeve joint part 121, respectively. The connecting part 112 is in a tubular shape with one end defining an opening. Connecting grooves are formed in the opening. In this embodiment, the connecting grooves are threaded grooves. The fitting is a screw, and opposite ends of the screw are respectively inserted into the threaded groove and the connecting hole 1215 at the same time, thus realizing the detachable connection between the first body 111 and the first sleeve joint part 121.

The electronic control module 13 includes a main control board 132 in addition to the battery 131, the button 133, the charging connector 134 and the display module 135. The battery 131, the button 133, the charging connector 134, the display module 135, the vacuum pump 15 and the control valve 16 are electrically connected to the main control board 132 respectively.

In some embodiments, the bottom cover 12 further includes at least one positioning member 123 for fixing the position of the main control board 132 in the accommodating chamber 17. Specifically, the positioning member 123 is arranged in a column shape, and a connecting groove for accommodating the fittings is formed in the positioning member 123. At least one connecting hole passes through the main control board 132, and the fittings pass through the connecting hole and the connecting groove, so as to fix the main control board 132 in the accommodating chamber 17.

In this embodiment, the number of the positioning members 123 and the connecting holes are four, and the number of the fittings is eight. Except for four for connecting the first body 111 and the first sleeve joint part 121, the remaining four are used for connecting the main control board 132 and the positioning members 123.

In this embodiment, the air extraction hole 1211 and the air inlet hole 1212 are both formed at the middle position of the second top wall, and the vacuum pump 15 and the battery 131 are respectively positioned at two opposite sides of the air extraction hole 1211 and the air inlet hole 1212. The control valve 16 is positioned between the vacuum pump 15 and the battery 131 through the accommodating part 122, and is positioned at one side of the air extraction hole 1211 and the air inlet hole 1212. The positioning members 123 are vertically arranged, so that the main control board 132 is located above the control valve 16, the air extraction hole 1211 and the air inlet hole 1212. The position arrangement of the electronic control module 13, the vacuum pump 15 and the control valve 16 can improve the utilization rate of the accommodating chamber 17 and ensure the miniaturization of the main machine 10.

In the specific use process, if there is a need to vacuum the first jar, the first jar mouth of the first jar needs to be placed in the first accommodating space 18, and the first jar mouth and the first sealing gasket 14 are in interference fit, so that the internal space of the first jar communicates with the first accommodating space 18 and is sealed from the external space. The first sealing cover is accommodated in the first accommodating space 18.

Further, the button 133 is pressed to make the vacuum pump 15 start vacuumizing, and the air in the first accommodating space 18 and the internal space of the first jar is pumped out through the pumping hole 1211, so that the first accommodating space 18 and the internal space of the first jar gradually become vacuum spaces.

It should be understood that at this time, because the diameter of the first sealing cover is smaller than the inner diameter of the second side wall, and the second top wall is provided with the first cushion blocks 1217, the first sealing cover will not block the communication between the inner space of the first jar and the air extraction channel during the vacuum pumping process.

During this process, the display module 135 displays the vacuumizing length of time. The target length of time of vacuum pumping can be controlled by the control system in the main control board 132. When the target time is reached, the vacuum pump 15 will automatically stop running and the vacuum pumping will automatically end.

Further, when the user wants to actively stop vacuumizing, he can press the button 133 again, to controls the vacuum pump 15 to stop vacuumizing through the control panel 132, and at the same time controls the control valve 16 to open the second connecting pipe, so that the air inlet hole 1212 is opened. At this time, the external atmospheric pressure is greater than the pressure of the first accommodating space 18 and the internal space of the first jar, therefore the first sealing cover located in the first accommodating space 18 is pushed to the first jar mouth under the action of the air pressure at the moment when the air inlet hole 1212 is opened, and the first jar mouth is sealed by the first sealing cover.

Further, since the first jar mouth is sealed by the first sealing cover, the internal space of the first jar remains in a vacuum state, while the first accommodating space 18 is in a non-vacuum state due to the opening of the air inlet hole 1212. At this time, the first jar can be removed from the main machine 10 to complete the vacuum pumping of the first jar.

As shown in FIGS. 3 and 4, in some embodiments, the air duct 30 includes a first end and a second end opposite to the first end, the first end may be selectively connected to the housing, and the second end is provided with a third sealing gasket 32 for sealing the gap at the connection with the compression bag, so as to facilitate vacuumizing the compression bag.

Specifically, the air duct 30 includes a fourth body 31, which is arranged in a tubular shape in this embodiment, and includes a tubular fourth portion 311 and a tubular fifth portion 312, which are connected with each other in the axial direction. The fourth portion 311 is used for selectively connecting with the housing. The end of the fifth portion 312 far from the fourth portion 311 is formed with an annular third sealing groove 3121 for accommodating the third sealing gasket 32, so as to seal the gap between the fifth portion 312 and the compression bag, and ensure the vacuum pumping effect.

It should be understood that the first end of the air duct 30 is the end of the fourth portion 311 away from the fifth portion 312, and the second end of the air duct 30 is the end of the fifth portion 312 away from the fourth portion 311. The fourth portion 311 is detachably connected with the housing, so that the air duct 30 can communicate with the air extraction hole 1211 and the air inlet hole 1212.

In some embodiments, the sealing device 1 further comprises a conversion structure 20, which may be selectively arranged on the housing of the main machine 10 for vacuumizing and sealing second jars.

The size of the second jar is different from that of the first jar, including a second jar mouth and a second sealing cover. The conversion structure 20 includes a second sleeve joint part 21, which defines at least one vent hole 2131 and a second accommodating space 23 adapted to the second jar mouth. The second accommodating space 23 communicates with the first accommodating space 18 through the vent hole 2131, so that the vacuum pump 15 can communicate with the second accommodating space 23 through the air extraction channel to vacuumize the inner space of the second jar communicated with the second accommodating space 23.

It should be understood that "the size of the second jar is different from that of the first jar" may mean that the diameter of the first jar mouth is larger than or smaller than that of the second jar mouth, or that the shapes of the first jar mouth and the second jar mouth are different, which is not specifically limited here. In this embodiment, the second jar mouth and the first jar mouth are both circular, and the diameter of the second jar mouth is smaller than that of the first jar mouth.

As shown in FIGS. 3 and 4, the second sleeve joint part 21 includes a first portion 211 and a second portion 212. The first portion 211 is tubular, and the second portion 212 is fixed on the upper end of the first portion 211, and the two parts are integrally formed.

The first portion 211 is detachably connected with the first sleeve joint part 121 of the housing, and comprises a tubular inner wall, a tubular outer wall and an annular bottom wall, wherein the inner edge of the bottom wall is connected with the lower end of the inner wall, and the outer edge of the bottom wall is connected with the lower end of the outer wall, so that the vertical section of the first portion 211 is similar to a U-shape.

Specifically, referring to FIG. 5 together, the outer contour of the outer wall is matched with the outer contour of the first side wall of the first body 111 of the upper cover 11, and both of them are rectangular structures with rounded corners at four corners, so that when the conversion structure 20 is assembled with the main machine 10, the second sleeve joint part 21 can be smoothly connected with the first body 111, which is convenient for taking and using.

In some embodiments, at least part of the outer wall surface of the first portion 211 is further provided with a second rib 2113, so as to improve the grasping friction during the assembly of the conversion structure 20 and the main machine 10.

As shown in FIG. 3, the upper end of the inner wall surface of the outer wall is provided with at least one first fitting structure 2111. Referring to FIG. 4 together, the lower end of the second side wall of the first sleeve joint part 121 is correspondingly formed with at least one first fitting groove 1214, and the first fitting groove 1214 cooperates with the first fitting structure 2111, so that the second sleeve joint part 21 can be detachably connected with the first sleeve joint part 121 by rotating.

In this embodiment, the number of the first mating structures 2111 and the first assembling grooves 1214 is four, which are respectively arranged one to one correspondence. In other alternative embodiments, the first mating structure can also be arranged on the first sleeve joint part 121, and the first fitting groove is arranged on the second sleeve joint part 21. Alternatively, the first sleeve joint part 121 and the second sleeve joint part 21 can be detachably connected by other assembly forms such as snap structure, screw connection and the like.

In some embodiments, a plurality of rib plates are further arranged between the inner wall and the outer wall of the first portion 211, and opposite ends of each rib plate are respectively connected with the outer circumferential surface of the inner wall and the inner circumferential surface of the outer wall for improving the strength of the first portion 211.

As shown in FIGS. 3 and 5, the second portion 212 includes a third top wall and a third side wall, and the third side wall is arranged in a tubular shape and fixed to the upper end of the third side wall. The lower end of the third side wall is connected with the upper end of the inner wall of the first portion 211, so that the second portion 212 and the first portion 211 are connected into a whole.

In this embodiment, the third side wall is tubular, and its outer diameter matches the inner diameter of the second side wall of the first sleeve joint part 121 of the bottom cover 12 (that is, the diameter of the first accommodating space 18). During assembling, the third side wall is in interference fit with the first sealing gasket 14 to achieve the sealing effect. When the second accommodating space 23 is connected to the second jar, the second accommodating space 23, the first accommodating space 18 and the inner space of the second jar form a sealed space, and the vacuum pump 15 vacuumizes the sealed space through the air extraction hole 1211.

In some embodiments, the inner diameter of the inner wall of the first portion 211 is adapted to the inner diameter of the third side wall of the second portion 212, so that the second accommodating space 23 is cylindrical with the same upper and lower diameters. As shown in FIG. 4, at least part of the inner wall of the first portion 211 is recessed inward to form an annular second sealing groove 2112. The conversion structure 20 further includes an annular second sealing gasket 22, which is accommodated in the second sealing groove 2112 in order to achieve an interference fit with the second jar mouth of the second jar, so as to ensure the sealing performance in the vacuum pumping process.

Specifically, the inner diameter of the inner wall of the first portion 211 and the inner diameter of the third side wall of the second portion 212 match the diameter of the second jar mouth, and are larger than the diameter of the second sealing cover. That is, the diameter of the second accommodating space 23 is adapted to the diameter of the second jar mouth and larger than the diameter of the second sealing cover, so as to ensure that the second sealing cover can move in the second accommodating space 23 when the second jar mouth and the second sealing cover of the second jar are arranged in the second accommodating space 23, and blocking the communication between the second accommodating space 23 and the internal space of the jar body of the second jar is avoided. The inner diameter of the second sealing gasket 22 is slightly smaller than the diameter of the second accommodating space 23 (or slightly smaller than the inner diameters of the first portion 211 and the third side wall) in order to achieve an interference fit with the second jar mouth.

It should be understood that in other alternative embodiments, the second sealing groove 2112 can also be formed by at least part of the inner wall surface of the first portion 211 and at least part of the inner wall surface of the third side wall of the second portion 212, that is, at least part of the side wall surface of the second accommodating space 23 is recessed to form the second sealing groove 2112.

In some embodiments, the second sleeve joint part 21 further includes a third portion 213, which includes a fourth top wall and a tubular fourth side wall, and the fourth top wall is arranged at the upper end of the fourth side wall, so that the third portion 213 has a tubular shape with one end closed and the other one end opened. The third top wall of the second portion 212 is annular in this embodiment, its inner diameter is adapted to the diameter of the fourth side wall, and the lower end of the fourth side wall is connected with the inner side of the second top wall. In this embodiment, the vent hole 2131 is formed in the fourth top wall.

In other alternative embodiments, the vent hole 2131 can also be formed in the fourth side wall or the third top wall. As long as it is ensured that the second sealing cover in the second accommodating space 23 will not block the vent hole 2131 during the vacuumizing of the second jar, the vacuumizing can be ensured smoothly.

In some embodiments, the lower end surface of the third top wall is further provided with at least one second cushion block 2121, which is used to define the position of the second sealing cover in the second accommodating space 23 during the vacuumizing process, so as to prevent the second sealing cover from closely contacting with the third top wall and blocking the vent hole 2131 due to the circulation of air during the vacuumizing process.

In this embodiment, the number of the second cushion blocks 2121 is multiple, and the second cushion blocks 2121 are arranged on the lower wall surface of the third top wall at intervals in the circumferential direction.

In this embodiment, the first portion 211, the second portion 212 and the third portion 213 are fixed together by integral molding. In other alternative embodiments, the first portion 211 and/or the second portion 212 and/or the third portion 213 can be fixed by welding, screwing, gluing and other means.

In the specific use process, after the conversion structure 20 is assembled with the main machine 10, the second jar mouth and the second sealing cover of the second jar adapted to the conversion structure 20 are set in the second accommodating space 23, and the inner space of the second jar is in communication with the second accommodating space 23. The button 133 is pressed to make the vacuum pump 15 start vacuumizing, and the vacuum pump 15 vacuumizes the first accommodating space 18, the second accommodating space 23 and the inner space inside the second jar through the air extraction port 151 and the air extraction hole 1211.

It should be understood that in this process, because the diameter of the second sealing cover is smaller than that of the second accommodating space 23, and the third top wall is provided with a plurality of second cushion blocks 2121, the second accommodating space 23 and the space in the second jar will always be in a communication state during the vacuumizing process, so as to ensure vacuumizing.

Further, when the user wants to finish vacuumizing, the button 133 is pressed again, so that the vacuum pump 15 stops working, and at the same time, the control valve 16 opens the second connecting pipe to open the air inlet hole 1212. Due to the different internal and external pressures, the second sealing cover located in the second accommodating space 23 is pressed on the second jar mouth, so that the second jar can be kept in a vacuum state and sealed. Then, the second jar can be removed from the conversion structure 20, and the vacuum pumping of the second jar is completed.

In some embodiments, the air duct 30 can also be selectively connected with the conversion structure 20, and the selective connection with the housing can be realized through the conversion structure 20, so that the sealing device 1 can not only vacuum two jars with different calibers, but also compression bags.

One end of the fourth body 31 of the air duct 30 is detachably connected with the second sleeve joint part 21 of the conversion structure 20, so that the air duct 30 can be communicated with the first accommodating space 18 through the vent hole 2131, so that the vacuum pump 15 can extract the air in the compression bag.

As shown in FIGS. 3 and 4, specifically, the fourth portion 311 of the fourth body 31 is detachably connected with the third portion 213 of the second sleeve joint part 21. Because the vent hole 2131 is formed on the third portion 213, it can be ensured that the second accommodating space 23 can communicate with the first accommodating space 18 when the air duct 30 is not assembled, and the third accommodating space 34 can communicate with the first accommodating space 18 when the air duct 30 is assembled.

It should be understood that the compression bag is provided with a connection port for communicating with the air duct 30, and the diameter of the second end of the fourth body 31 (that is, the end of the fifth portion 312 far away from the fourth portion 311) needs to be adapted to the size of the connection ports provided on the compression bag, which is not limited here. The outer diameter of the first end of the fourth body 31 (that is, the end of the fourth portion 311 far away from the fifth portion 312) needs to match the inner diameter of the fourth side wall of the third portion 213.

In this embodiment, the diameter of the second end is larger than that of the first end, the fourth portion 311 is arranged in a cylindrical shape with equal upper and lower diameters, and the diameter of the fifth portion 312 gradually increases from the end close to the fourth portion 311 to the end far from the fourth portion 311. In other alternative embodiments, the fourth body 31 can also be in an L-shaped or other structure with opposite two ends open, or in a structure with one end open and the other end closed, the closed end provided with connecting holes.

At least one second fitting groove 3111 is formed on the outer side surface of the fourth portion 311, and at least one second mating structure 2132 is provided on the inner side surface of the fourth side wall of the second sleeve joint part 21 of the conversion structure 20. The second fitting groove 3111 and the second mating structure 2132 cooperate with each other, and the detachable connection between the air duct 30 and the conversion structure 20 is realized by the second mating structure 2132 rotatably engaged in the second fitting groove 3111. In this embodiment, the number of the second assembly slots 3111 and the second fitting structures 2132 are both two.

In other alternative embodiments, the second fitting groove can also be provided on the second sleeve joint part 21, and the second mating structure can also be provided on the fourth portion 311. Alternatively, the second sleeve joint part 21 and the fourth body 31 can be detachably connected by other assembly forms such as snap structure and screw connection.

Referring to FIG. 5 together, in some embodiments, an annular fourth sealing groove 3112 is formed on the outer wall surface of the fourth portion 311, and the air duct 30 further includes a fourth sealing gasket 33, which is arranged in the fourth sealing groove 3112 and used for sealing the gap at the joint of the fourth portion 311 and the third portion 213 when the air duct 30 is assembled with the conversion structure 20.

Specifically, the outer diameter of the fourth sealing gasket 33 is greater than the outer diameter of the fourth portion 311, that is, the outer diameter of the fourth sealing gasket 33 is greater than the inner diameter of the fourth side wall, so as to ensure that the fourth sealing gasket 33 can be in interference fit with the fourth side wall and ensure the sealing effect.

It should be understood that this "selective connection" means detachable connection in this embodiment, and the function of vacuumizing jars or compression bags with different sizes can be realized by selectively detachably connecting the conversion mechanism 20 and/or the air duct 30 with the main machine 10.

In the specific use process, when the compression bag needs to be vacuumized, it is needed to assemble the conversion structure 20 on the main machine 10 first, and then assemble the air duct 30 on the conversion structure 20, so that the end of the fifth portion 312 of the air duct 30 far away from the fourth portion 311 is communicated with the connection port of the compression bag, so that the vacuum pump 15 communicates with the interior space of the compression bag through the air extraction port 151, the air extraction hole 1211, the first accommodating space 18 and the third accommodating space 34.

Further, the button 133 is pressed to start the vacuum pump 15, so that the vacuum pump 15 can vacuum the whole space consisted of the first accommodating space 18, the third accommodating space 34 and the interior space in the compression bag through the air extraction port 151 and the air extraction hole 1211.

When the user wants to stop vacuumizing, he can press the button 133 again to stop the vacuum pump 15, and at the same time, the control valve 16 is opened, and the first accommodating space 18 and the third accommodating space 34 are restored to the non-vacuum state, thus completing the vacuumizing of the compression bag.

Understandably, the above embodiment only expresses the preferred embodiment of the present disclosure, and its description is more specific and detailed, but it cannot be understood as limiting the patent scope of the present disclosure. It should be pointed out that for those skilled in the art, the above technical features can be freely combined without departing from the concept of this present disclosure, and some modifications and improvements can be made, which all belong to the protection scope of this present disclosure. Therefore, all equivalent transformations and modifications made with the scope of the claims of this present disclosure shall belong to the scope of the claims of this present disclosure.

What is claimed is:

1. A sealing device configured for sealing a first sealing cover on a first mouth of a first container, the sealing device comprising a main machine, the main machine comprising:

a housing comprising a first sleeve joint part, wherein the first sleeve joint part defines a first accommodating space adapted to the first mouth;

a vacuum pump mounted to the housing and comprising an air extraction port;

an air extraction channel defined in the housing and communicating the air extraction port with the first accommodating space;

an air inlet channel defined in the housing and communicating the first accommodating space with ambient air; and a control valve mounted to the housing and used for controlling open and close of the air inlet channel;

wherein the sealing device further comprises an air duct, and one end of the air duct is selectively connected to the housing and is respectively communicated with the air inlet channel and the air extraction channel; and wherein the sealing device further comprises a conversion structure for sealing a second sealing cover on a second mouth of a second container, and an outer diameter of the second mouth is not equal to that of the first mouth; the conversion structure is selectively connected to the housing; the air duct is selectively connected to the housing through the conversion structure.

2. The sealing device according to claim 1, wherein the first sleeve joint part comprises a top wall and a tubular side wall extending from a periphery of the top wall, and at least one air extraction hole and at least one air inlet hole are formed on the top wall; and the air extraction hole communicates the air extraction channel with the first accommodating space, and the air inlet hole communicates the air inlet channel with the first accommodating space.

3. The sealing device according to claim 2, wherein an annular first sealing groove is defined in an inner surface of the side wall, the main machine further comprises an annular first sealing gasket, and the first sealing gasket is arranged in the first sealing groove.

4. The sealing device according to claim 2, wherein an air inlet recess is formed on a lower end surface of the top wall, and both the air extraction hole and the air inlet hole are formed in a wall of the air inlet recess.

5. The sealing device according to claim 2, wherein a lower end surface of the top wall is provided with at least one first cushion block.

6. The sealing device according to claim 1, wherein the air duct comprises a first end and a second end opposite to the first end, the first end is selectively connected to the housing, and the second end is provided with a third sealing gasket.

7. The sealing device according to claim 1, wherein the sealing device further comprises a main control board which is arranged in the housing, the vacuum pump and the control valve are electrically connected to the main control board respectively.

8. The sealing device according to claim 1, wherein the conversion structure comprises a second sleeve joint part, the second sleeve joint part defines a second accommodating space adapted to the second mouth; and a vent hole communicating the second accommodating space with the first accommodating space is formed in the second sleeve joint part.

9. The sealing device according to claim 8, wherein the second sleeve joint part comprises a second portion and an annular first portion, wherein the second portion comprises a top wall and a tubular side wall, the top wall is arranged at an upper end of the side wall, and the first portion is arranged at a lower end of the side wall; an outer diameter of the side wall is matched with a diameter of the first accommodating space, and an inner diameter of the side wall is matched with an inner diameter of the first portion, and the first portion is selectively connected with the housing.

10. The sealing device according to claim 9, wherein at least part of an inner surface of the first portion or at least part of the inner surfaces of the first portion and the side wall of the second portion are formed with an annular second sealing groove, and the conversion structure further comprises an annular second sealing gasket which is arranged in the second sealing groove; inner diameters of the first portion and the side wall are adapted to an outer diameter of the second mouth and larger than a diameter of the second sealing cover, and inner diameters of the second sealing gasket are smaller than those of the first portion and the third side wall.

11. The sealing device according to claim 9, wherein the second sleeve joint part further comprises a third portion, and the third portion comprises a top wall and a tubular side wall; the top wall of the second portion is set in an annular manner; the top wall of the third portion is arranged at an upper end of the side wall of the third portion, a lower end of the side wall of the third portion is connected with an inner side of the top wall of the second portion, and the at least one vent hole is formed on the top wall of the third portion.

12. The sealing device according to claim 9, wherein at least one second cushion block is arranged on a lower end surface of the top wall of the second portion.

13. The sealing device according to claim 8, wherein one end of the air duct is selectively connected to the second sleeve joint part and is communicated with the first accommodating space through the vent hole.

14. The sealing device according to claim 13, wherein the second sleeve joint part comprises a third portion, and the third portion comprises a top wall and a tubular side wall, and the top wall of the third portion is arranged at an upper end of the side wall of the third portion, and the at least one vent hole is formed in the top wall of the third portion;

the air duct comprises a fourth body and a fourth sealing gasket, wherein the fourth body is selectively connected with the third portion, and comprises a fourth portion and a fifth portion which are connected along an axial direction; an outer diameter of the fourth portion is matched with an inner diameter of the fourth side wall, an annular fourth sealing groove is formed in an outer wall surface of the fourth portion, and the fourth sealing gasket is arranged in the fourth sealing groove; and an outer diameter of the fourth sealing gasket is larger than that of the fourth portion.

15. A sealing device configured for sealing a first sealing cover on a first mouth of a first container, comprising a main machine, the main machine comprising:

a housing comprising a first sleeve joint part, wherein the first sleeve joint part defines a first accommodating space adapted to the first mouth;

a vacuum pump mounted to the housing and comprising an air extraction port;

an air extraction channel defined in the housing and communicating the air extraction port with the first accommodating space;

an air inlet channel defined in the housing and communicating the first accommodating space with ambient air; and a control valve mounted to the housing and used for controlling open and close of the air inlet channel;

wherein the sealing device further comprises an air duct, and one end of the air duct is detachably connected to the housing and is respectively communicated with the air inlet channel and the air extraction channel;

wherein the sealing device further comprises a conversion structure for sealing a second sealing cover on a second mouth of a second container, and an outer diameter of the second mouth is not equal to that of the first mouth; the conversion structure is detachably connected to the housing; the air duct is detachably connected to the housing through the conversion structure.

16. The sealing device according to claim 15, wherein the first sleeve joint part comprises a top wall and a tubular side wall extending from a periphery of the top wall, and at least one air extraction hole and at least one air inlet hole are formed on the top wall; and the air extraction hole communicates the air extraction channel with the first accommodating space, and the air inlet hole communicates the air inlet channel with the first accommodating space.

17. The sealing device according to claim 15, wherein the conversion structure comprises a second sleeve joint part, the second sleeve joint part defines a second accommodating space adapted to the second mouth; and a vent hole communicating the second accommodating space with the first accommodating space is formed in the second sleeve joint part;

wherein one end of the air duct is detachably connected to the second sleeve joint part and is communicated with the first accommodating space through the vent hole.

18. The sealing device according to claim 15, wherein the sealing device further comprises a main control board which is arranged in the housing, the vacuum pump and the control valve are electrically connected to the mam control board respectively.

* * * * *